US007387061B2

(12) United States Patent
Kobata et al.

(10) Patent No.: US 7,387,061 B2
(45) Date of Patent: Jun. 17, 2008

(54) CONTROL APPARATUS FOR HYDRAULIC CYLINDER

(75) Inventors: Hiroshi Kobata, Sagamihara (JP); Rollin C. Christianson, Delafield, WI (US); Christopher John Kolbe, Muskego, WI (US)

(73) Assignees: HUSCO International, Inc., Waukesha, WI (US); Kayaba Industry Company, Ltd., Tokyo (JP)

( * ) Notice: Subject to any disclaimer, the term of this patent is extended or adjusted under 35 U.S.C. 154(b) by 0 days.

(21) Appl. No.: 11/566,869

(22) Filed: Dec. 5, 2006

(65) Prior Publication Data

US 2007/0144165 A1 Jun. 28, 2007

Related U.S. Application Data

(63) Continuation of application No. 10/550,574, filed on Mar. 26, 2004, now abandoned.

(30) Foreign Application Priority Data

Mar. 26, 2003 (JP) ..... 2003-084929

(51) Int. Cl.
*F15B 15/22* (2006.01)
*F01B 31/12* (2006.01)

(52) U.S. Cl. ..... 91/405; 60/461; 91/361; 91/445; 92/85 R

(58) Field of Classification Search ..... 60/461; 91/1, 361, 405, 435, 445; 92/5 R, 85 R, 92/85 B See application file for complete search history.

(56) References Cited

U.S. PATENT DOCUMENTS 3,800,662 A * 4/1974 Ackley ..... 91/1
3,933,080 A * 1/1976 Corrie ..... 91/405
4,033,250 A * 7/1977 Pinkstaff ..... 91/405
4,523,511 A * 6/1985 Dixon ..... 91/405
4,700,611 A * 10/1987 Kaneko ..... 91/405
4,896,582 A * 1/1990 Tordenmalm et al. ..... 91/361
5,138,838 A * 8/1992 Crosser ..... 91/461

FOREIGN PATENT DOCUMENTS

JP 61-153003 7/1986
JP 63-088304 4/1988

(Continued)

*Primary Examiner*—Michael Leslie
(74) *Attorney, Agent, or Firm*—Quarles & Brady; George E. Haas

(57) ABSTRACT

Cushion chambers (8) disposed in the vicinity of both ends of a hydraulic cylinder (1) to throttle inflow or outflow of an operating oil caused by a piston (5) moving close to a piston stroke end, pressure sensors (16, 17) to detect pressures in the cushion chambers (8), and a control valve (13) disposed in a passage to supply/drain the operating oil to and from oil chambers (6, 7) of the hydraulic cylinder (1) for varying a flow amount of the operating oil are provided. A controller (9) varies an opening degree of the control valve (13) within a piston stroke end range based upon outputs of the pressure sensors (16, 17), adjusts a cushion pressure and controls a moving speed of the piston (5). Thereby deceleration degrees of the piston (5) can be freely adjusted within the piston stroke end range based upon a change of the operating conditions of the hydraulic cylinder (1).

6 Claims, 3 Drawing Sheets

FOREIGN PATENT DOCUMENTS

| | | |
|---|---|---|
| JP | 02-072201 | 3/1990 |
| JP | 04-303392 | 10/1992 |
| JP | 05-133401 | 5/1993 |
| JP | 06-330907 | 11/1994 |
| JP | 11-108014 | 4/1999 |
| JP | 11-325294 | 11/1999 |
| JP | 2000-120603 | 4/2000 |

* cited by examiner

CONTROL APPARATUS FOR HYDRAULIC CYLINDER

CROSS-REFERENCE TO RELATED APPLICATIONS

This application is a continuation of U.S. patent application Ser. No. 10/550,574 filed on Mar. 26, 2004 now abandoned.

FIELD OF THE INVENTION

This invention relates to a control apparatus for a hydraulic cylinder which can absorb an impact shock generated when a piston reaches a stroke end.

RELATED ART

Conventionally, there is, for example, such a type of control apparatus for a hydraulic cylinder as shown in FIG. 5. (refer to Japanese Unexamined Patent Publication No. 11-108014). FIG. 5 shows, for example a hydraulic drive circuit attached in a hydraulic power shovel that is provided with a hydraulic pump P supplying an operating oil, a hydraulic cylinder 51 including cushion mechanisms 61, 62 each disposed in both sides of a piston 50, a direction control valve 60 controlling flow of the operating oil supplied to the hydraulic cylinder 51 from the hydraulic pump P, and a pressure adjustment unit changing pressure of the operating oil supplied to the hydraulic cylinder 51 in accordance with magnitude of a cushion pressure (hydraulic pressure) generated in a rod-side oil chamber 52 or a bottom-side oil chamber 53 of the hydraulic cylinder 51. This pressure adjustment unit is equipped with selection valves 54, 55 to detect the magnitude of the cushion pressure generated in the oil chamber 52 and the oil chamber 53 for outputting a pilot pressure signal in accordance with the detected cushion pressure, and a variable relief valve 56 adapted to gradually reduce a discharge pressure of the hydraulic pump P as a value of the pilot pressure signal outputted from these selection valves 54, 55 increases.

The cushion mechanisms 61, 62 are constructed in such a way that convex portions 61*a*, 62*a* disposed respectively in both sides of the piston 50 enter into vent bores 61*b*, 62*b* disposed in a side of a cylinder body within a cushion stroke range, whereby flow of the operating oil flowing out from the oil chamber 53 or the oil chamber 52 is throttled to produce a high cushion pressure in each oil chamber 52, 53. This allows a piston speed to be reduced and as a result an impact shock to be generated when the piston 50 reaches a piston stroke end is absorbed and cushioned. However, an extremely rapid cushion pressure rise reduces an absorption effect of the impact shock.

Therefore, as the piston 50 of the hydraulic cylinder 51 is displaced and enters into a cushion stroke range as a result of introducing a pressurized oil discharged from the hydraulic pump P to the oil chamber 52 or the oil chamber 53 of the hydraulic cylinder 51 by the direction control valve 60, the pressure of the pressurized oil supplied to the hydraulic cylinder 51 is controlled to vary in accordance with the cushion pressure by the pressure adjustment unit.

As the cushion pressure of the oil chamber gradually increases by the pressure adjustment unit, the discharge pressure of the hydraulic pump P is reduced, whereby the pressure of the pressurized oil supplied to the hydraulic cylinder 51 is controlled to be gradually reduced to less than the pressure supplied for driving the hydraulic cylinder 51 before the piston 50 enters into the cushion stroke range. Thereby a pushing force of the piston 50 reduces to less than a pushing force thereof before the piston 50 enters into the cushion stroke range to restrict the cushion pressure generated in a cushion oil chamber.

However, since in such conventional control apparatus of the hydraulic cylinder, the pressure adjustment unit is designed to adjust a discharge pressure of the hydraulic pump P in accordance with a cushion pressure without any other modulation, deceleration of the piston 50 can not be adjusted in accordance with a change of operating conditions, for example a speed of the piston 50 or the like. This conventional control apparatus thus has the problem with reduction of degrees of freedom in a cushion pressure control.

DISCLOSURE OF THE INVENTION

It is an object of the present invention to provide a control apparatus for a hydraulic cylinder which can freely control a cushion speed of a piston in accordance with a change of operating conditions.

A control apparatus for a hydraulic cylinder according to the present invention comprises a hydraulic cylinder including a piston slidably disposed in a cylinder tube and a pair of oil chambers defined by the piston, a cushion chamber disposed in the vicinity of each end of the hydraulic cylinder to throttle inflow or outflow of an operating oil caused by the piston moving close to a piston stroke end, a pressure sensor to detect pressure of the cushion chamber, a control valve disposed in a passage to supply/drain the operating oil to and from the oil chambers of the hydraulic cylinder for varying a flow amount of the operating oil, and a controller to determine a piston stroke end range based upon an output of the pressure sensor, and vary an opening degree of the control valve to lower a moving speed of the piston at the piston end range.

When the piston enters into the piston stroke end range and thereby the pressure of the cushion chamber is increased, the controller detects that the piston enters into the piston stroke end range and then varies the opening degree of the control valve. As a result, the pressure of the operating oil in the oil chamber of the hydraulic cylinder is controlled to lower a piston speed. The pressure in the oil chamber can be freely adjusted in accordance with an opening degree of the control valve, which makes it possible to freely control a deceleration degree of the piston, namely cushion characteristics in accordance with operating conditions of the hydraulic cylinder.

BEST MODE FOR CARRYING OUT THE INVENTION

Embodiments according to the present invention will be described below with reference to the accompanying drawings.

Figure 1:
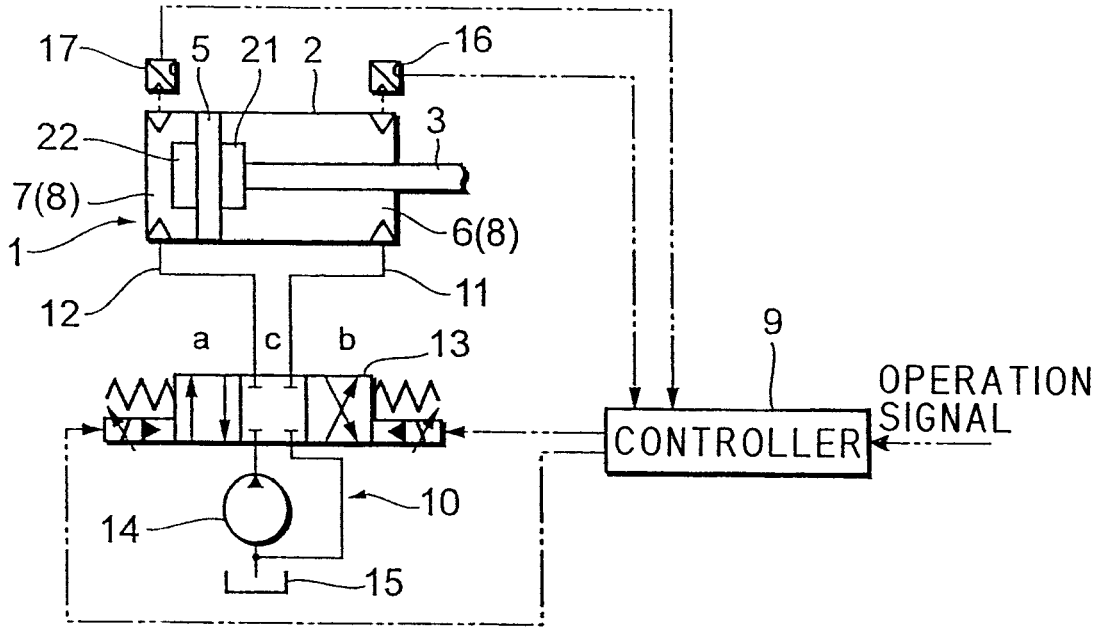
FIG. 1 is a view of a control apparatus for a hydraulic cylinder showing an embodiment of the present invention.

As shown in FIG. 1, a hydraulic cylinder 1 is equipped with a cylinder tube 2, a piston rod 3 extending from one end of the cylinder tube 2, a piston 5 connected to the piston rod 3 and sliding on an inner surface of the cylinder tube 2, and a head-side oil chamber 6 and a bottom-side oil chamber 7 divided by the piston 5.

The hydraulic cylinder 1 moves the piston 5 based upon a difference in pressure between each operating oil acting on both faces of the piston 5 to expand/contract the piston rod 3.

A hydraulic circuit 10 is connected to the oil chamber 6 and the oil chamber 7 of the hydraulic cylinder 1 for supplying and draining the operating oil. The hydraulic circuit 10 is equipped with supply/discharge passages 11, 12 connected to the oil chamber 6 and the oil chamber 7 and a control valve 13 to switch the supply/drain passages 11, 12 selectively to a discharge side of a pump 14 and a side of a reservoir 15.

The control valve 13 includes an expansion position (a) where the supply/drain passage 12 is communicated with the discharge side of the pump 14 and the supply/drain passage 11 is communicated with the side of the reservoir 15 to expand the hydraulic cylinder 1, a contraction position (b) where the supply/drain passage 11 is communicated with the discharge side of the pump 14 and supply/drain passage 12 is communicated with the side of the reservoir 15 to contract the hydraulic cylinder 1, and a stop position (c) where both the supply/drain passages 11, 12 are closed to stop the hydraulic cylinder 1.

And the hydraulic cylinder 1 is equipped with cushion rings 21, 22 connected to both sides of the piston rod 3 and cushion chambers 8 disposed in both sides of the hydraulic cylinder 1 for cushioning an impact shock generated when the piston reaches the piston stroke end. The cushion chambers 8 are adapted to form a cushion restriction for throttling an outlet of the oil chamber 6 or 7 when the cushion ring 21 or 22 comes close.

When the piston 5 comes close to the piston stroke end and the cushion ring 21 or 22 comes close to the cushion chamber 8, flow resistance against the operating oil flowing out from the oil chamber 6 or 7 occurs and the pressure in the cushion chambers 8 increases to slow down the piston 5.

A controller 9 is provided for varying deceleration degrees of the piston at the piston stroke end and varies an opening degree of the control valve 13.

The control valve 13 is an electromagnetic proportional flow control valve that switches a flow direction of the operating oil by a drive current supplied from the controller 9, as well as varies a supply flow amount of the operating oil to the hydraulic cylinder 1.

Pressure sensors 16, 17 are connected to the oil chambers 6 and 7 to detect, based upon a pressure change in the cushion chambers 8, that the piston 5 reaches the piston stroke end. Pressures in the oil chambers 6 and 7 detected by the pressure sensors 16, 17 are outputted to the controller 9.

The controller 9 incorporates an external operation signal and detection values from the pressure sensors 16, 17 and outputs a drive signal in accordance with the operation signal and the detection values to the control valve 13.

And the controller 9 compares a predetermined cushion pressure judgment value with the detection values from the pressure sensors 16, 17 and when the detection values go beyond the judgment value, the controller 9 determines that a piston displacement range thereafter is a piston stroke end range. And in the piston stroke end range, the controller 9 outputs a command of throttling an opening degree of the control valve 13. The supply flow amount of the operating oil to the hydraulic cylinder 1 is thus reduced in the piston stroke end range to restrict pressure in the supply-side oil chamber for reducing the piston speed or the drain flow amount of the operating oil from the hydraulic cylinder 1 is reduced in the piston stroke end range to increase pressure in the drain-side oil chamber for reducing the piston speed likewise.

And the controller 9 adjusts a throttling degree of the operating angle of the control valve 13 based upon operating conditions or the like of the hydraulic cylinder 1, whereby absorption and cushion characteristics of the impact shock generated when the piston 5 reaches the piston stroke end can be freely changed.

Operations of the control apparatus for the hydraulic cylinder constituted as above will be explained next.

When the external operation signal is inputted, the controller 9 outputs a signal in accordance with the operation signal to the control valve 13. For example, when a command to expand the hydraulic cylinder 1 is given from an outside, the controller 9 send a signal to the control valve 13 for switching the control valve 13 to a side of the expansion position a. When the control valve 13 is switched to the side of the expansion position a, the operating oil is supplied to the oil chamber 7 in the hydraulic cylinder 1 from the supply/drain passage 12, as well as the operating oil in the oil chamber 6 is drained from the supply/drain passage 11 to the reservoir 15, thereby to displace the piston 5 toward the right direction in FIG. 1.

When the piston 5 is displaced to the vicinity of the piston stroke end, the resistance produced by the cushion ring 21 against the flow of the operating oil flowing from the cushion chamber 8 as the right-handed oil chamber 6 increases and the cushion chamber 8 is compressed, whereby the cushion pressure is increased to decelerate the piston 5. On the other hand, when the controller 9 checking a detection value from the pressure sensor 16 detects an increase of the cushion pressure, the controller 9 outputs to the control valve 13 a signal to throttle an opening degree of the control valve 13. This allows the supply amount supplied to the hydraulic cylinder 1 or the drain amount drained from the hydraulic cylinder 1 to reduce, and the piston 5 is displaced to the piston stroke end while the piston 5 further slows down.

Note that, similar to the contrary case where the hydraulic cylinder 1 is contracted, the piston speed can be reduced at the piston stroke end.

Since the piston 5 having entered within the piston stroke end range is displaced while thus slowing down, occurrence of an impact shock at the piston stroke end is properly prevented.

And in this case, an extra high pressure due to a rapid increase of the cushion pressure in the cushion chamber 8 is not produced and instrument damages caused by the extra high pressure can be avoided and further, no occurrence of the extra high pressure in the cushion chambers 8 causes withstand pressure strength required for the cylinder tube 2 defining the cushion chambers 8 to be reduced.

Moreover, the cushion chamber 8s may be constructed in such a way that the pressure in the cushion chambers 8 in the vicinity of the piston stroke end is increased to be a little higher than in the range prior to the piston stroke end.

Accordingly a high work accuracy for a restriction flow passage defined by the cushion rings 21, 22 is not required so much and it is the easier to manufacture it. And reduction in resistance of the cushion rings 21, 22 allows the speed of the piston 5 away from the piston stroke end to be increased. Therefore, when the hydraulic cylinder 1 that has reached the piston stroke end is operated to move in the opposite direction, since the operating oil is smoothly supplied to the expanding oil chamber, it is not necessary for the operating oil to enter into the cushion chamber by bypassing the cushion restriction, and accordingly a check valve, a circuit or the like for that is not required.

Note that just in case the deceleration control by the controller 9 can not be performed due to failures of the pressure sensors 16, 17, since the cushion action to reduce a speed of the piston 5 still works as a result of compressing the cushion chambers 8 within the piston stroke end range, the impact shock generated when the piston 5 reaches the piton stroke end can be cushioned to provide a failsafe.

And since the pressure in each of the cushion chambers 8 detected by the pressure sensors 16, 17 is a larger value as compared to a normal control pressure, a slight initial adjustment for the pressure sensors 16, 17 becomes unnecessary.

Figure 2:
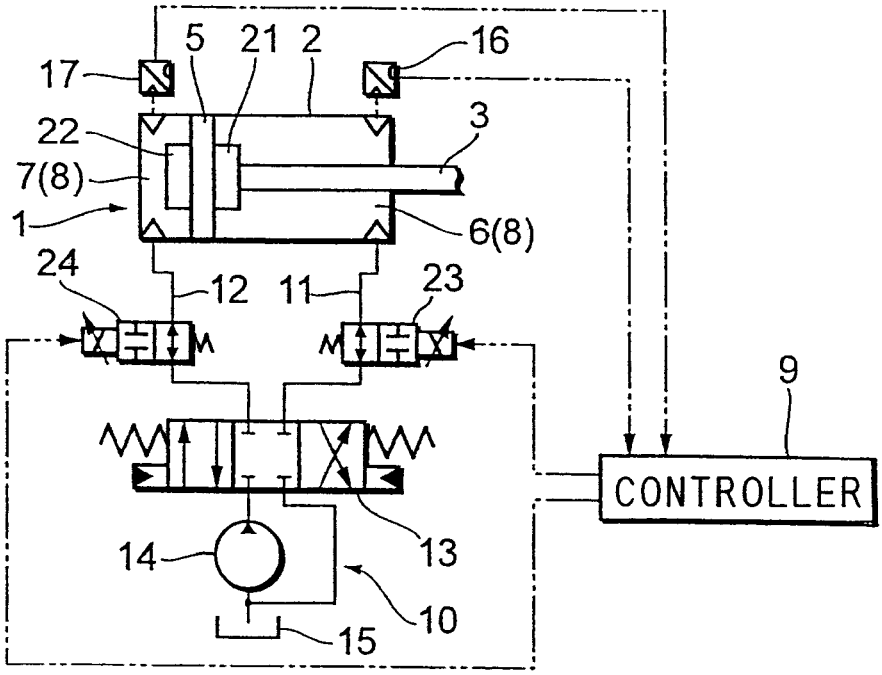
FIG. 2 is a view of a control apparatus showing another embodiment.

Next, a second preferred embodiment will be explained with reference to FIG. 2.

In this embodiment, a first flow control valve 24 and a second flow control valve 23 are interposed in the supply/drain passages 11, 12 between the control valve 13 and the hydraulic cylinder 1. The first flow control valve 24 is disposed in the supply/drain passage 12 and the second flow control valve 23 is disposed in the supply/drain passage 11. Opening degrees of the first flow control valve 24 and the second flow control valve 23 are controlled by the controller 9, thereby to adjust a supply amount to the hydraulic cylinder 1 or a drain amount from the hydraulic cylinder 1.

For example, in case the control valve 13 is switched to the expansion position (a) to expand the hydraulic cylinder 1, adjustment of the supply amount to the hydraulic cylinder 1 is performed by the first flow control valve 24 and adjustment of the drain amount from the hydraulic cylinder 1 is performed by the second flow control valve 23. On the contrary, in case the control valve 13 is switched to the contraction position (b) to contract the hydraulic cylinder 1, the adjustment of the supply amount to the hydraulic cylinder 1 is adapted to be performed by the second flow control valve 23 and the adjustment of the drain amount from the hydraulic cylinder 1 is adapted to be performed by the first flow control valve 24.

Accordingly the adjustment of the supply amount to the hydraulic cylinder 1 and the adjustment of the drain amount from the hydraulic cylinder 1 are separately performed by the individual flow control valves 23, 24 and a cushion action of the hydraulic cylinder 1 can be more accurately controlled in accordance with operating conditions. And in this case, unlike the first preferred embodiment, the control valve 13 does not necessarily have a function to vary a flow amount.

Note that the flow control by the controller 9 may be performed only by the supply flow amount to the hydraulic cylinder 1 or only by the drain flow amount from the hydraulic cylinder 1.

Figure 3:
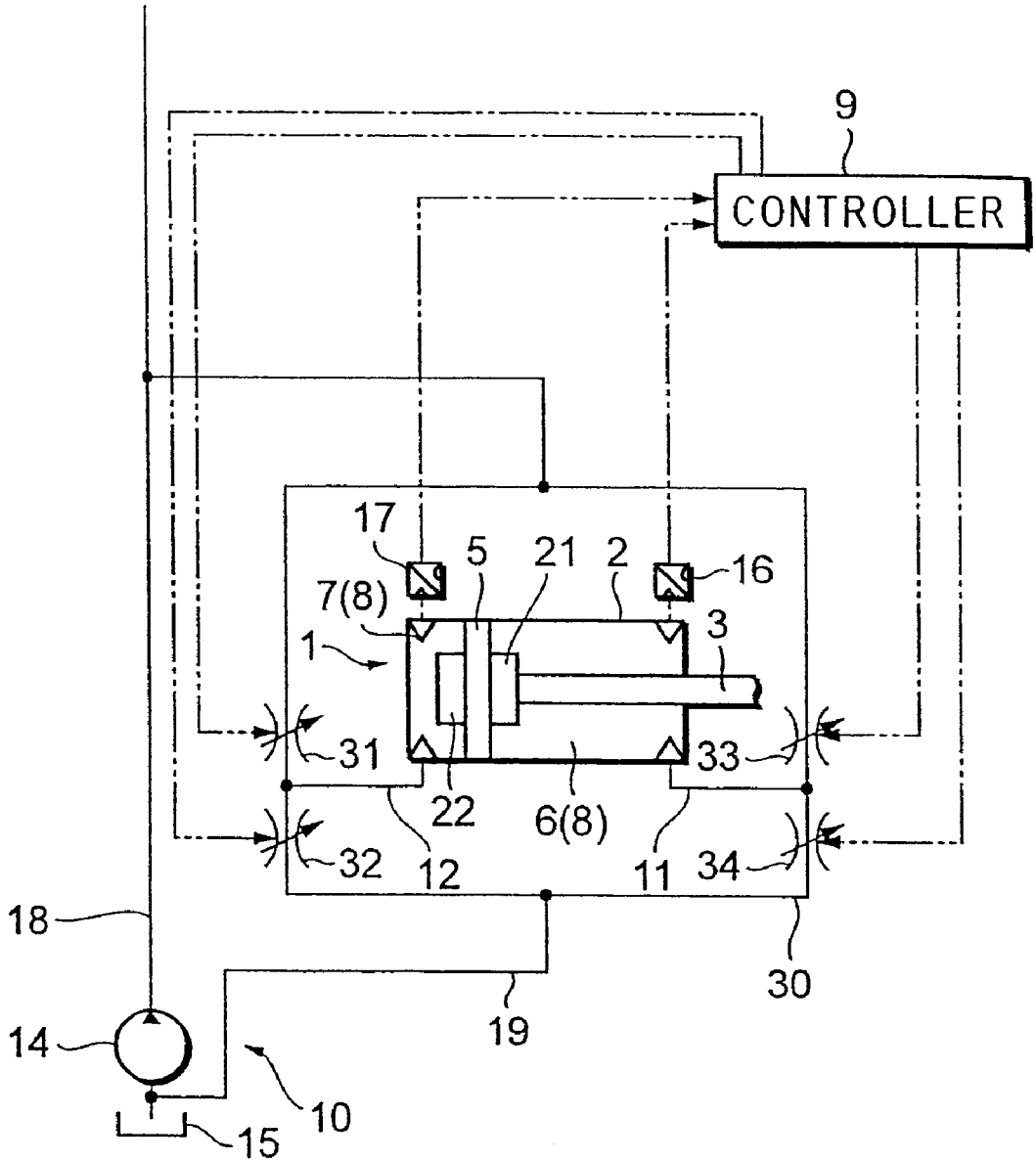
FIG. 3 is a view of a control apparatus showing a different embodiment.

Next, a third preferred embodiment will be explained with reference to FIG. 3.

A bridge circuit 30 is interposed between a discharge-side passage (high pressure-side pressure source) 18 of the pump 14 and a return passage (low pressure side) 19 communicated with the reservoir 15, and four flow control valves 31-34 to adjust pressure of an operating oil introduced to the hydraulic cylinder 1 are disposed in the bridge circuit 30. The discharge-side passage 18 of the pump 14 is connected between the flow control valves 31, 33 and the return passage 19 is connected between the flow control valves 32, 34. The supply/drain passage 12 is connected between the flow control valves 31, 32 and the supply/drain passage 11 is connected between the flow control valves 33, 34. Each of the flow control valves 31-34 is driven by a signal sent from the controller 9 and adjusts a throttling amount in accordance with the signal. Accordingly, the supply flow amount of the operating oil to the hydraulic cylinder 1 or the drain flow amount of the operating oil flowing out from the hydraulic cylinder 1 can be controlled by adjusting a throttling amount of each flow control valve 31-34.

Operations of this preferred embodiment are as follows. For example, in case the hydraulic cylinder 1 is operated to be expanded, the flow control valves 31, 34 are opened and the other flow control valves 32, 33 are closed Thereby all the operating oil discharged from the pump 14 enters through the flow control valve 31 and the supply/drain passage 12 into the oil chamber 7 of the hydraulic cylinder 1 to expand the piston 5. And the operating oil drained from the oil chamber 6 enters through the supply/drain passage 11 and the flow control valve 34 into the reservoir 15. When the piston 5 expands and enters into the piston stroke end range, and further, the pressure sensor 16 detects an increase of the cushion pressure, the controller 9 sends a signal to throttle an opening degree of the flow control valve 31. Then the supply flow amount to the hydraulic cylinder 1 is reduced and the pressure of the operating oil in the oil chamber 7 is reduced, thereby to lower the operating speed of the piston 5, which can cushion an impact shock at a piston stroke end.

And when an opening degree of the flow control valve 32 is widened with no change of an opening degree of the flow control valve 31, different from the above, a part of the operating oil passing through the flow control valve 31 enters into a side of the flow control valve 32, and accordingly the operating oil supplied to the hydraulic cylinder 1 is reduced to slow down an operating speed of the piston 5 in the same as shown above.

Furthermore, for the purpose that the supply flow amount to the hydraulic cylinder 1 is not reduced but the drain flow amount from the hydraulic cylinder 1 is reduced and the operating speed of the piston 5 is lowered by building up a backpressure in the oil chamber 6, an opening degree of the flow control valve 34 may be throttled.

On the other hand, in case the hydraulic cylinder 1 is contracted, the flow control valves 33, 32 are opened and the other flow control vales 31, 34 are closed. Thereby the operating oil discharged from the pump 14 flows through the flow control valve 33 and the supply/drain passage 11 into the oil chamber 6 of the hydraulic cylinder 1, and the operating oil in the oil chamber 7 flows through the supply/drain passage 12 and the flow control valve 32 into the reservoir 15, caused by the movement of the piston 5. And when the piston rod 3 is contracted and enters into the piston stroke end range, the controller 9 sends to the flow control valve 33 a command to throttle the opening degree thereof. As a result, the supply flow amount to the hydraulic cylinder 1 is reduced and the pressure of the operating oil in the oil chamber 6 is lowered to slow down the operating speed of the piston 5.

In order to reduce the supply flow amount to the hydraulic cylinder 1, the opening degree of the flow control valve 34 may be widened with no change of the opening degree of the flow control valve 33. In this case, since a part of the operating oil passing through the flow control valve 33 flows from the flow control valve 34 into the reservoir 15, the supply flow amount to the hydraulic cylinder 1 can be reduced.

Note that the supply flow amount to the hydraulic cylinder 1 is not controlled, but the drain flow amount from the hydraulic cylinder 1 may be controlled. In this case this control is performed by throttling an opening degree of the flow control valve 32.

As described above, by adjusting an opening degree of each flow control valve 31-34, the supply flow amount to the hydraulic cylinder 1 or the drain flow amount from the hydraulic cylinder 1 can be adjusted arbitrarily.

And it becomes possible to mutually perform controls of a reduction of the supply flow amount to the hydraulic cylinder 1 through the flow control vales 31, 33, and an increase of the backpressure by reducing the drain flow amount from the hydraulic cylinder 1 through the flow control valves 32, 34, and as a result, degrees of slowing down the movement of the piston 5 can be variously adjusted.

And the flow control valves 31-34 are mounted in the vicinity of the hydraulic cylinder 1, and the flow control valve disposed in the passage where the operating oil is flown out from the oil chamber compressed by a load acting on the hydraulic cylinder 1 is closed, whereby at least flowing of the operating oil flown out from the hydraulic cylinder 1 is stopped to stop the movement of the hydraulic cylinder 1, namely a function of a falling-prevention valve can be performed.

Figure 4:
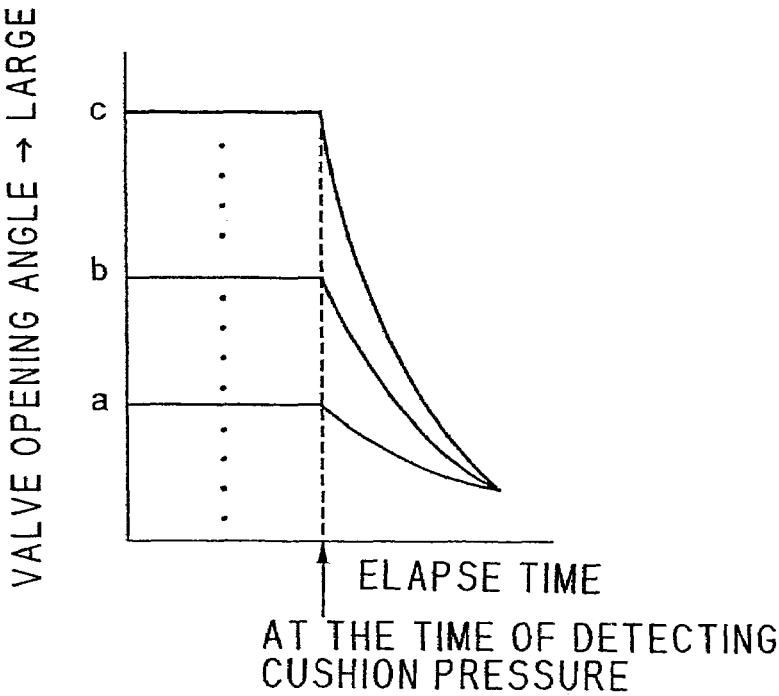
FIG. 4 is a characteristic graph showing a piston deceleration characteristic.
Figure 5:
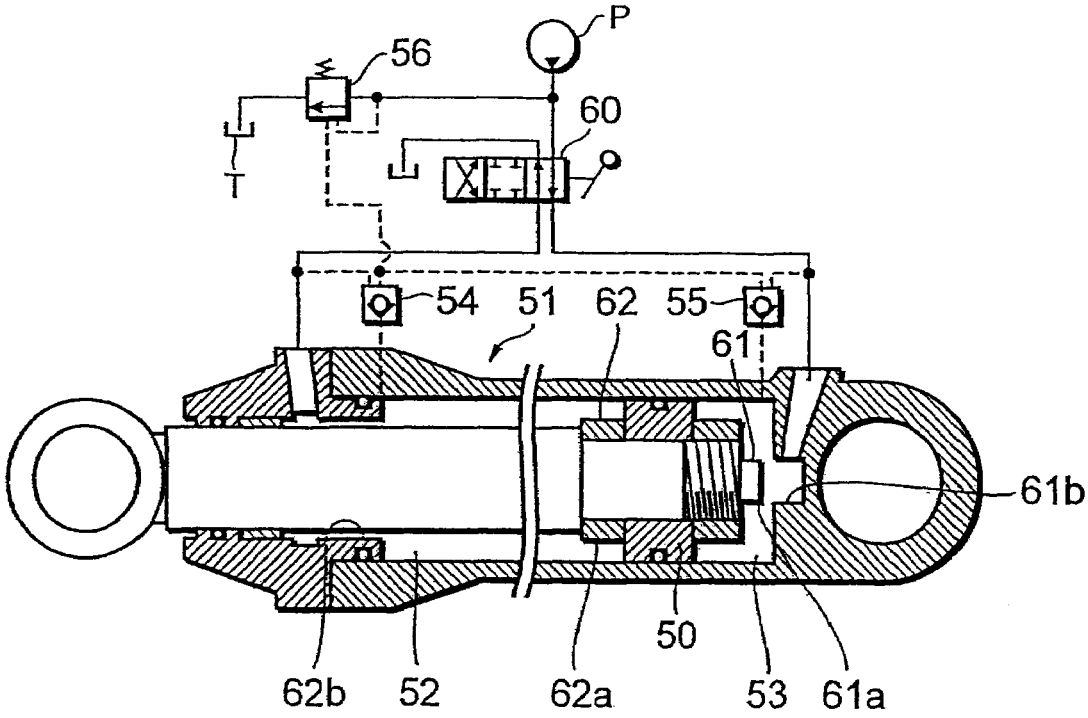
PRIOR ART FIG. 5
FIG. 5 is a view showing a constitution of the conventional art.

With reference next to FIG. 4, deceleration characteristics of the piston 5 within a piston stroke end range will be explained. FIG. 4 is a characteristic graph showing a relation between a valve opening degree and an elapse time, more particularly throttling degrees of a valve opening degree in the piston stroke end range after detecting the cushion pressure. Since an opening degree of the valve is approximately proportional to an operating speed of the piston 5, throttling the valve opening degree in the piston stroke end range, namely means slowing down the operating speed of the piston 5.

The controller 9 has, in advance, a map as shown in FIG. 4, and a valve opening degree command is outputted to each of the above-mentioned control valves (control valve 13, first and second flow control valves 23, 24, each flow control valve 31-34) according to this map.

For example, when the valve opening degree is "c" in FIG. 4, the moving speed of the piston 5 is faster than when the other valve opening degrees is "a" or "b". Accordingly when the valve opening degree is throttled from a starting point of the piston stroke end range (when the cushion pressure reaches a judgment value), the piston 5 slows down quickly by rapidly throttling it.

On the other hand, when the valve opening degree is, for example, "a", since the valve opening degree is small and the moving speed of the piston 5 is slow, the piston 5 slows down by gradually throttling the valve opening degree from a starting point of the piston stroke end range.

Note that a valve opening degree command in the piston stroke end range is not necessarily extracted from a map, but may be calculated at any time based upon a moving speed of the piston 5 or an elapse time.

For example, the controller 9 may calculate a speed of the piston 5 in accordance with a variation rate of detection values by the pressure sensors 16, 17, and output to each control valve a signal for more deceleration of the piston 5 as the calculated speed of the piston 5 is faster in the piston stroke end range.

And the operating speed of the piston 5 gets faster as a load acting on the hydraulic cylinder 1 becomes larger. Accordingly the controller 9 calculates a drain flow amount or a supply flow amount of the operating oil based upon pressure detection values of the cushion chambers 8, a valve opening degree of each control valve (control valve 13, first and second control flow valves 23, 24, each flow control valve 31-34) and the like, and calculates a moving speed of the piston 5 based upon the flow amount per hour. As the calculated value of the moving speed of the piston 5 in the piston stroke end range is higher, the controller 9 may control a valve opening degree of each control valve to be smaller, thereby to increase deceleration degrees of the piston 5.

According to the above-mentioned methods, the piston 5 can be not only smoothly decelerated in a piston stroke end range, but also the deceleration characteristic (deceleration degrees) can be freely set by the controller 9. As a result, for example, it is possible to control the deceleration degrees of the piston 5 with the characteristic in which the piston 5 is decelerated in the primary and the secondary way or a step way.

The present invention is not limited to the above-mentioned preferred embodiments, but it is apparent that various modulations can be made within the scope of the technical spirit.

INDUSTRIAL APPLICABILITY

The present invention is applicable as a control apparatus of a hydraulic cylinder for industrial machinery.

The invention claimed is:

1. A control apparatus for a hydraulic cylinder, comprising:

the hydraulic cylinder including a piston slidably disposed in a cylinder tube and a pair of oil chambers defined by the piston;

a cushion chamber disposed in the vicinity of each end of the hydraulic cylinder to throttle inflow or out flow of an operating oil caused by the piston moving close to a piston stroke end;

a pressure sensor to detect pressure of the cushion chamber;

a control valve assembly disposed in a passage to supply/drain the operating oil to and from the oil chambers of the hydraulic cylinder for varying a flow amount of the operating oil, wherein the control valve assembly includes a first flow control valve and second flow control valve which are interposed in the supply/drain passage respectively, and further comprises a control valve disposed in the supply/drain passage in series with both the first flow control valve and the second flow control valve, wherein operation of the control valve determines a direction that the piston moves within the cylinder tube; and a controller to determine a piston stroke end range based upon a output of the pressure sensor, and vary an opening degree of the control valve assembly to lower a moving speed of the piston at the piston stroke end range.

2. The control apparatus for the hydraulic cylinder according to claim 1, wherein:

one of the first flow control valve and the second flow control valve adjusts a supply flow amount of the operating oil to the hydraulic cylinder by a drive current sent from the controller.

3. The control apparatus for the hydraulic cylinder according to claim 1, wherein:

one of the first flow control valve and the second flow control valve adjusts a drain flow amount of the operating oil flowing out from the hydraulic cylinder by a drive current sent from the controller.

4. The control apparatus for the hydraulic cylinder according to claim 1, wherein:

the controller determines that the piston enters into the piston stroke end range based upon when a pressure detection value in the cushion chamber goes beyond a predetermined value, and reduces the opening degree of the control valve assembly within piston stroke end range for lower a moving speed of the piston.

5. The control apparatus for the hydraulic cylinder according to claim 4, wherein:

when the controller determines that the piston enters into the piston stroke end range, the controller decreases deceleration degrees of the moving speed of the piston in accordance with an elapse time after the piston enters into the piston stroke end range.

6. The control apparatus for the hydraulic cylinder according to claim 4, wherein:

when the controller determines that the piston enters into the piston stroke end range, the controller calculates the moving speed of the piston relative to the flow amount of the operating oil based upon the pressure detection value of the cushion chamber and the opening degree of the control valve assembly, and increases the deceleration degrees of the moving speed of the piston.

* * * * *